US007237500B2

(12) United States Patent
Armstrong et al.

(10) Patent No.: US 7,237,500 B2
(45) Date of Patent: Jul. 3, 2007

(54) HULL CONSTRUCTION FOR SIDE HULLS OF TRIMARAN AND THE LIKE

(75) Inventors: Neville A. Armstrong, Coogee (AU); Samuel Abbott, Beldon (AU)

(73) Assignee: Austal Ships Pty Ltd, Henderson (AU)

( * ) Notice: Subject to any disclaimer, the term of this patent is extended or adjusted under 35 U.S.C. 154(b) by 28 days.

(21) Appl. No.: 11/225,890

(22) Filed: Sep. 14, 2005

(65) Prior Publication Data

US 2006/0243182 A1 Nov. 2, 2006

(30) Foreign Application Priority Data

Sep. 15, 2004 (AU) ..... 2004905330

(51) Int. Cl.
*B63B 9/06* (2006.01)
*B63B 3/08* (2006.01)
*B63B 35/00* (2006.01)

(52) U.S. Cl. ..... 114/65 R; 114/77 R; 114/39.25; 114/39.26

(58) Field of Classification Search ..... None
See application file for complete search history.

(56) References Cited

U.S. PATENT DOCUMENTS 2,150,958 A * 3/1939 Alexander ..... 114/356
4,714,041 A * 12/1987 Jaffre et al. ..... 114/67 A

* cited by examiner

*Primary Examiner*—Jesus Sotelo
*Assistant Examiner*—Daniel V. Venne
(74) *Attorney, Agent, or Firm*—Stites & Harbinson PLLC; Ross F. Hunt, Jr.

(57) ABSTRACT

An amah for a high speed seagoing multi hulled vessel, the amah having sides extending upwardly and outwardly from a base line, the sides having longitudinally extending vertically spaced stiffeners, the bow of the amah including a plate field comprising a plurality of sub plates each comprising a vertical plate secured along the centre line of the amah and supporting a horizontal plate secured to each side of the amah, whereby the planes of the horizontal plates of the sub plates step upwardly as the base line rakes upwardly towards the bow and the longitudinal stiffeners terminate and are secured to the horizontal plates.

10 Claims, 9 Drawing Sheets

HULL CONSTRUCTION FOR SIDE HULLS OF TRIMARAN AND THE LIKE

INTRODUCTION

This invention relates to the construction of amahs, that is the side hulls of a trimaran or pentamaran vessel.

BACKGROUND OF THE INVENTION

Trimarans usually comprise a large central hull supported on each side by outrigging side hulls known as amahs. The outrigging side hulls are usually smaller in length and cross section than the main hull and have considerably less draft. The amahs are designed to provide buoyant support for a trimaran, especially at slow speeds and also to provide adequate stability. For a high speed vessel it is required that the amahs should be as small as possible to minimise drag and thus naval architects generally design trimarans with the amahs of minimal length and width consistent with the need for adequate stability.

The width of the amahs in way of the water must also be minimized in order to reduce the drag and reduce the generation of waves which may impact upon the main (centre) hull of the trimaran, thus causing additional drag. Typically the width of the amah in the water for a vessel having a length of about 120 metres may be as small as 700 millimeters at the top, tapering down to zero width at the bottom. Access for construction and maintenance is further substantially limited because of the internal stiffening structure.

The very narrow breadth of a trimaran amah makes the structure very narrow and introduces considerable problems in construction due to lack of access. The angle formed by the side plates at the bow of an amah in plan can be as low as 2° and usually less than 8° which obviously considerably constricts the available space.

It is also usual to reinforce the plating of hulls of this kind with longitudinally extending stiffeners which would become very closely packed together as the bow comes to a point and there is a need to terminate the stiffeners on a structure that is able to distribute the loads carried by the stiffeners.

It is these issues that have brought about the present invention.

SUMMARY OF THE INVENTION

In accordance with the present invention there is provided an amah for a high speed seagoing multi hulled vessel, the amah having sides extending upwardly and outwardly from a base line, the sides having longitudinally extending vertically spaced stiffeners, the bow of the amah including a plate field comprising a plurality of sub plates each comprising a vertical plate secured along the centre line of the amah and supporting a horizontal plate secured to each side of the amah, whereby the planes of the horizontal plates of the sub plates step upwardly as the base line rakes upwardly towards the bow and the longitudinal stiffeners terminate and are secured to the horizontal plates.

Preferably the vertical plates are secured to a solid bar extending along the base line.

Preferably each sub plate is reinforced by at least one supporting web positioned between the horizontal plate and the vertical plate on each side of the vertical plate.

In a preferred embodiment the amah is asymmetrical in cross section.

Preferably each sub plate is between 500 and 1500 mm in length and the horizontal plate height varies from between 500 mm and 1500 mm above the adjacent horizontal plate.

DESCRIPTION OF THE DRAWINGS

An embodiment of the present invention will now be described by way of example only with reference to the accompanying drawing in which.

DESCRIPTION OF THE PREFERRED EMBODIMENT

Figure 1:
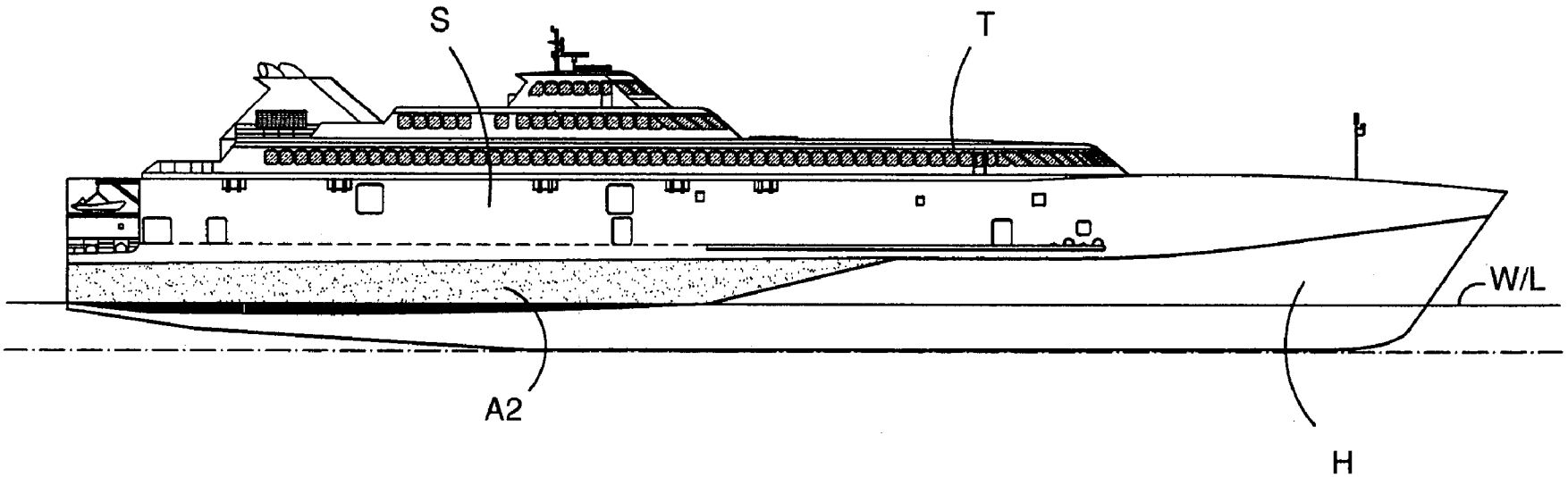
FIG. 1 is a side elevational view of a trimaran.
Figure 2:
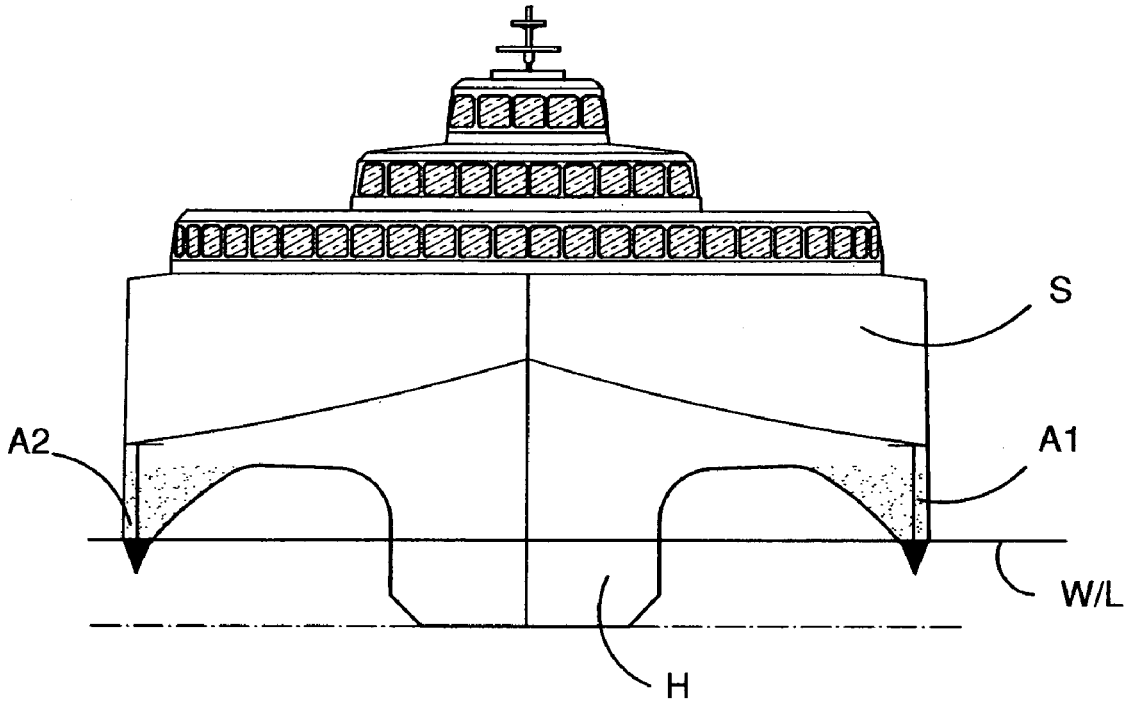
FIG. 2 is a front elevational view of the trimaran.
Figure 3:
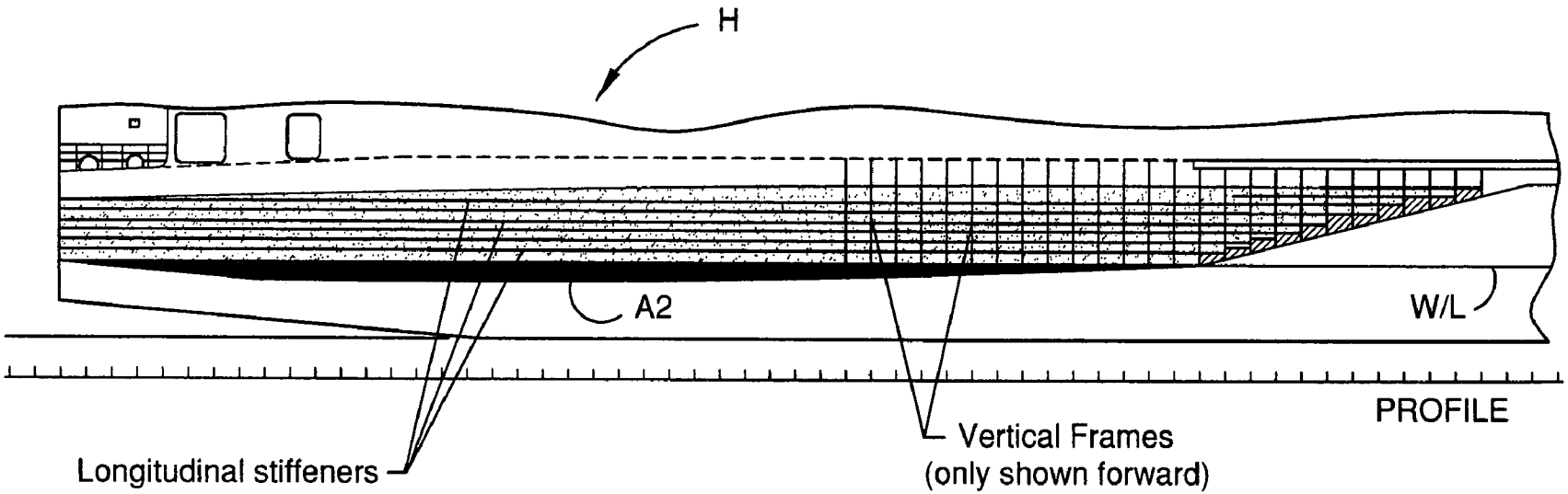
FIG. 3 is a side view of an amah of the trimaran.
Figure 4:
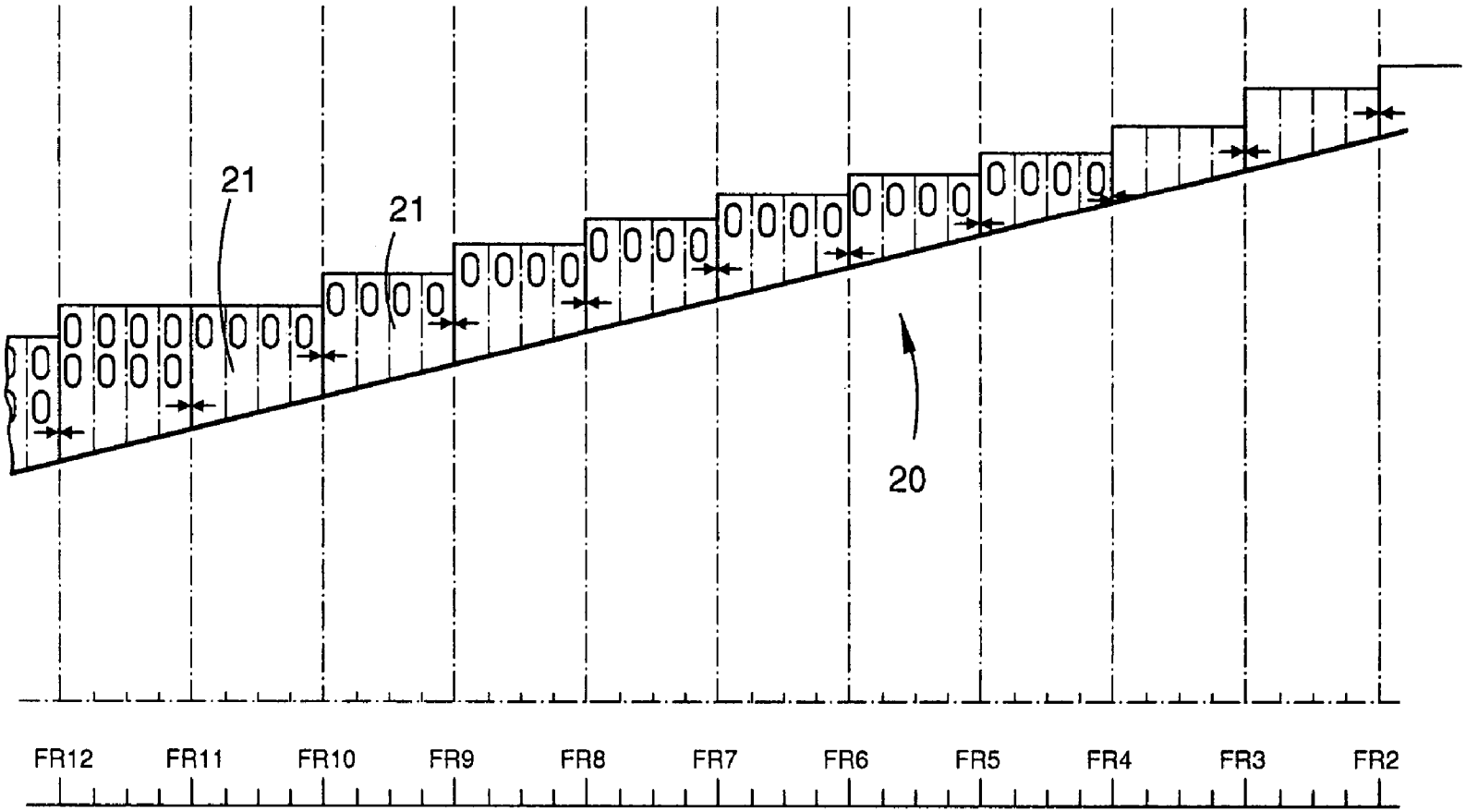
FIG. 4 is an elevation at the centre of the amah illustrating a plate field.

As shown in FIGS. 1 to 3, a trimaran T has a superstructure S supported by a main hull H and laterally spaced outrigging side hulls A1 and A2. The trimaran is a high speed passenger and vehicle carrying vessel that is greater than 50 metres in length and preferably constructed in aluminum. The side hulls A1 and A2 are usually referred to as amahs and are arranged as shown in FIG. 1. As can be seen from FIGS. 1 and 2, the amahs only extend a short distance below the water line WL.

As mentioned earlier in this specification, the narrowness makes it very difficult to construct the amah.

Amahs 10 of this kind usually include side plating 11 of aluminium reinforced with longitudinally extending side stiffeners 12 that may be elongate extrusions of "T", "L" or "P" cross section that are welded vertically spaced to the side plates to extend longitudinally of the amah.

Figure 9:
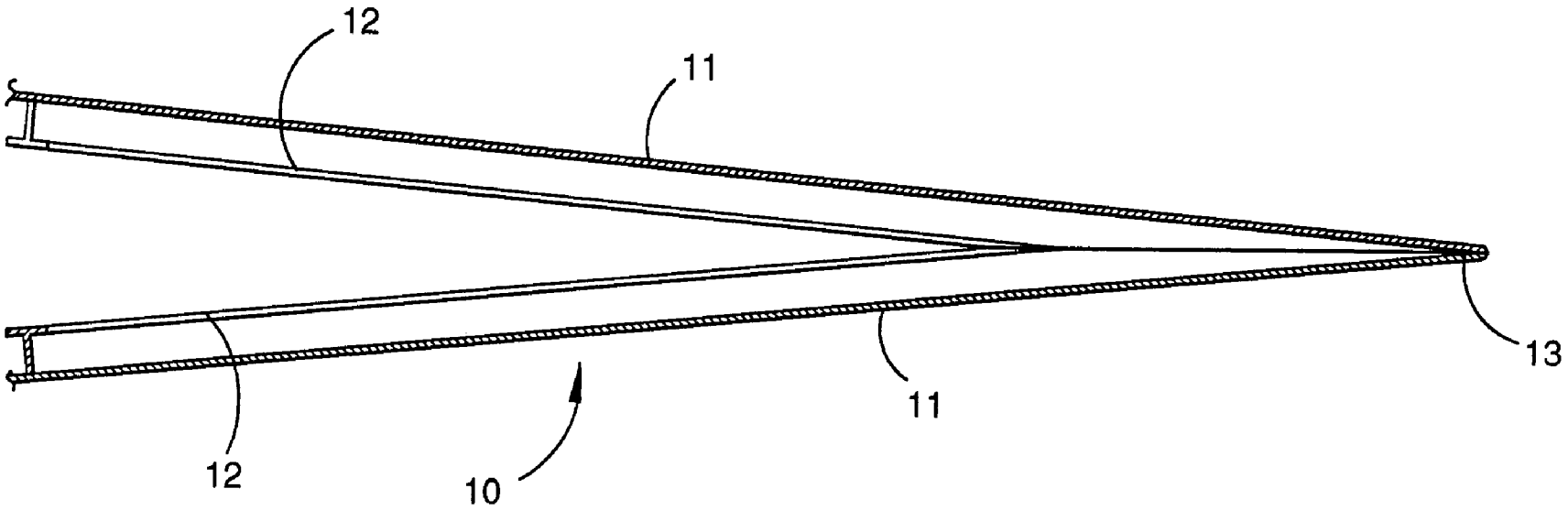
FIG. 9 is a plan view of the bow of the amah.

As shown in FIGS. 9 and 10 at the bow 13 of the amah 10 there is inadequate access for fabrication and the spacing of the stiffeners 12 becomes too congested for fabrication.

Figure 7:
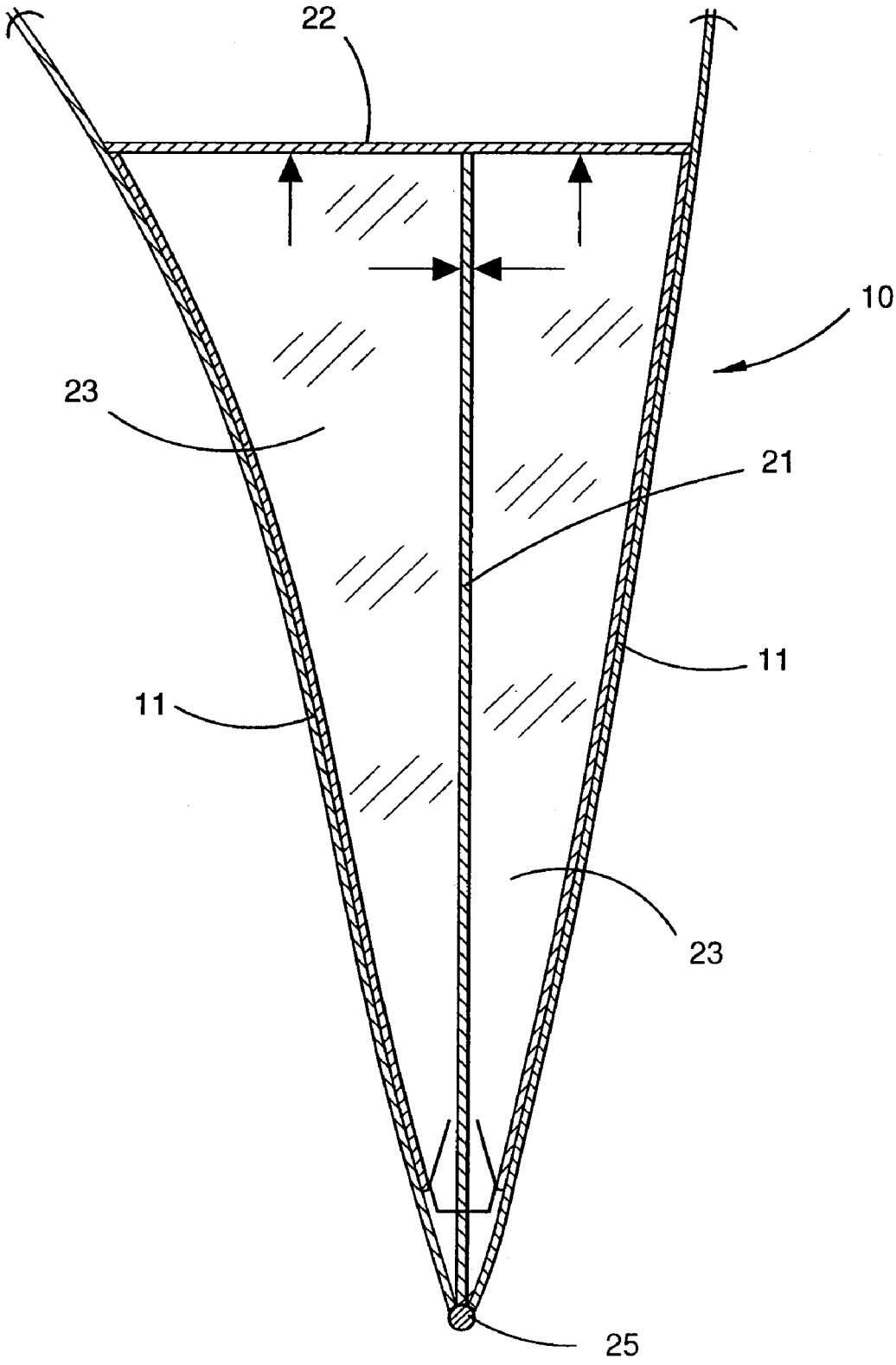
FIG. 7 is a cross sectional view of the base of the amah.
Figure 8:
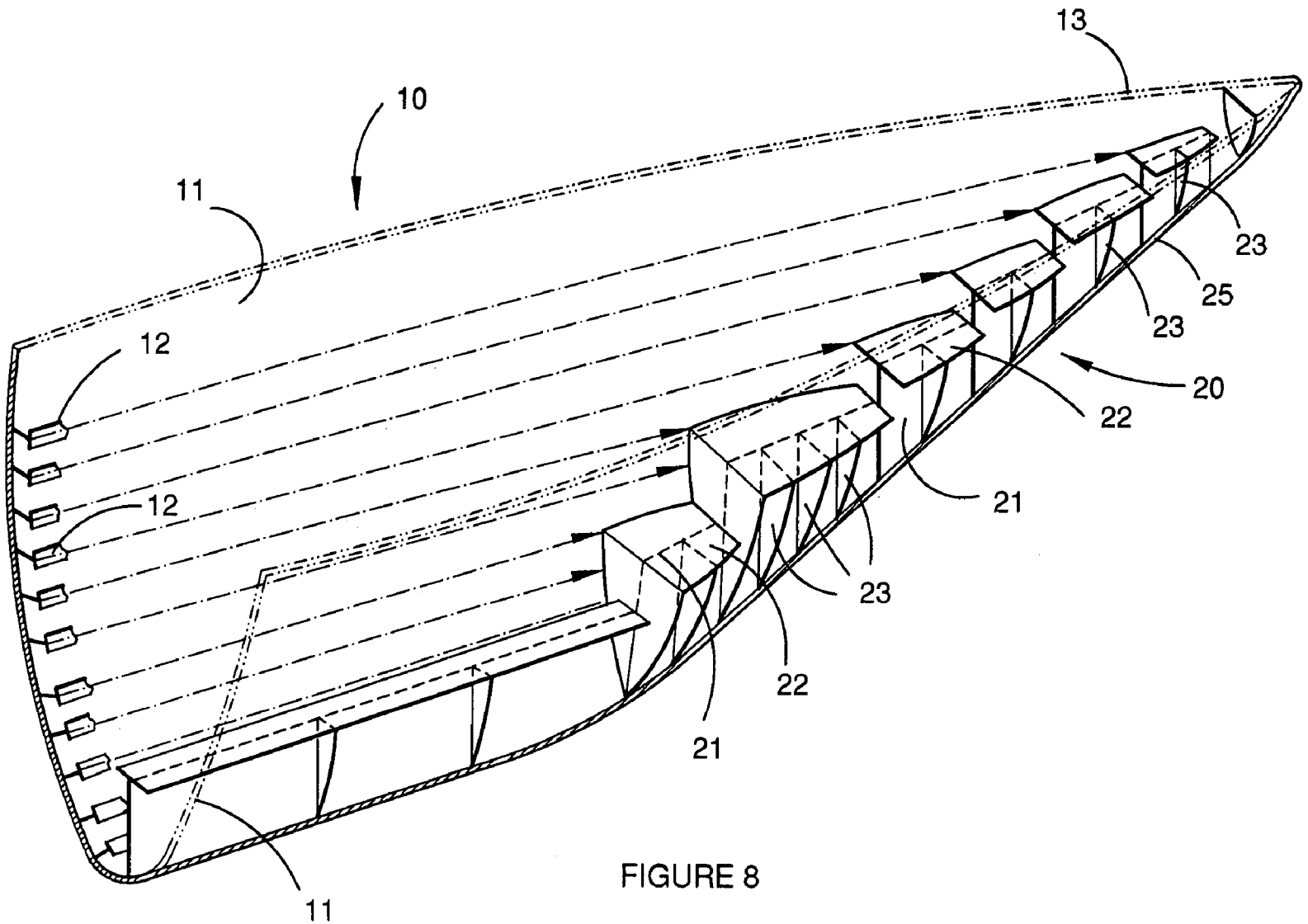
FIG. 8 is a schematic perspective view of the front of the amah illustrating the association of the plate field and the side stiffeners.

As shown in FIGS. 7 and 8, this problem is solved by providing a plate field 20 at the forward end of the amah that facilitates location of the stiffening supports 12.

The plate field 20 comprises a series of sub-fields, each of which includes a vertical plate 21 that is welded along the center line of the underside of a horizontal plate 22. A series (usually three) of strengthening webs 23 are secured between the vertical 21 and horizontal plates 22 in a spaced apart manner on each side of the vertical plate. The vertical plate 21 is welded to a round bar 25 that extends along the base of the amah down the centre line. Each sub-plate field extends upwardly to a height of between 500 and 1500 mm, that is to a height that is sufficiently large to permit access for fabrication. Each sub-plate field extends between adjacent frames to a longitudinal distance of between 500 mm to 1500 mm and each sub-plate field may extend over two or more frames. The reinforcing webs 23 are spaced approximately between 200 and 500 mm apart. The horizontal plates 22 extend between the side plates 11 on each side of the amah 10.

Figure 5:
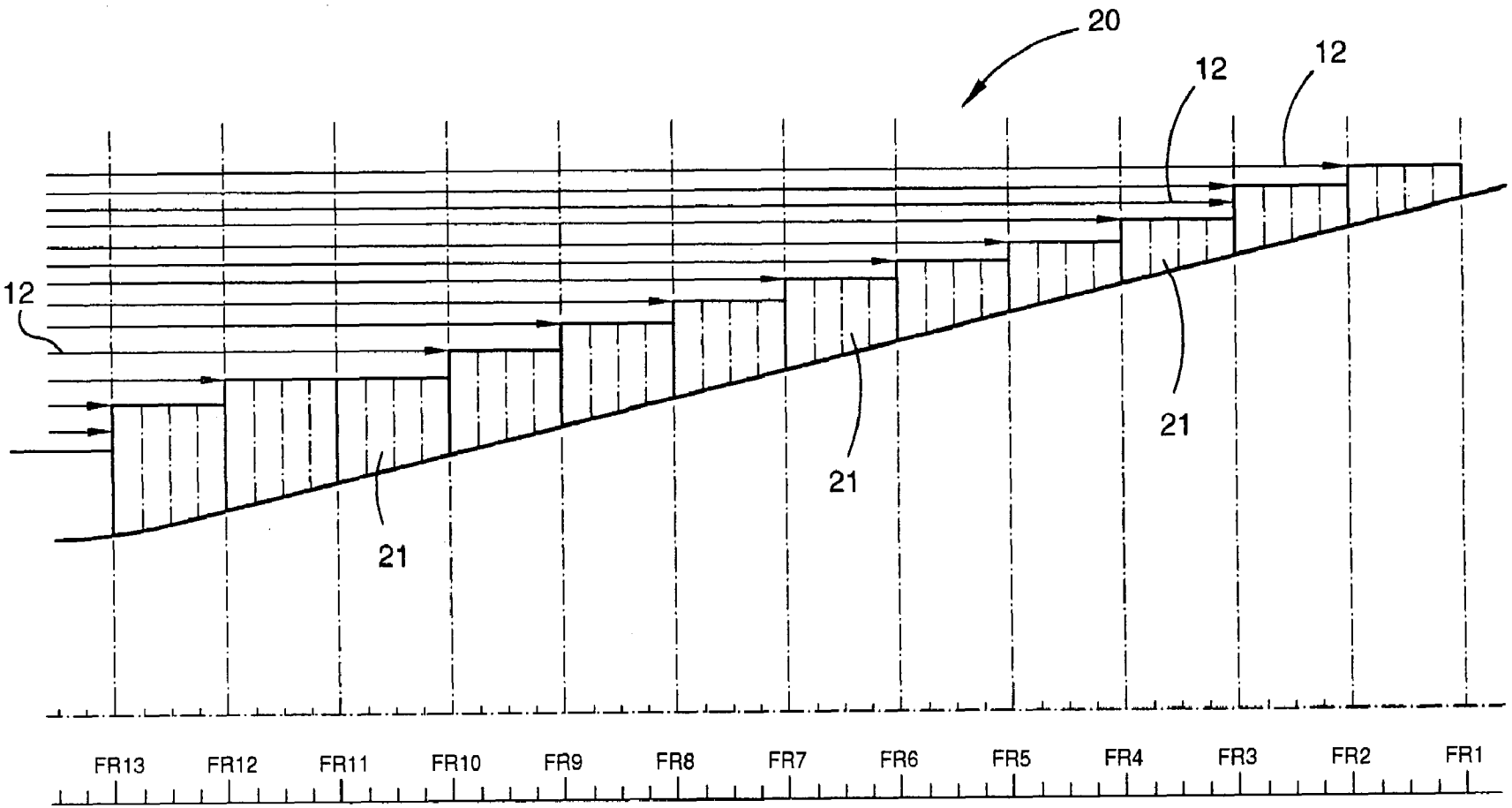
FIG. 5 is an elevation at the side of the amah illustrating attachment of side stiffeners to the plate field.
Figure 6:
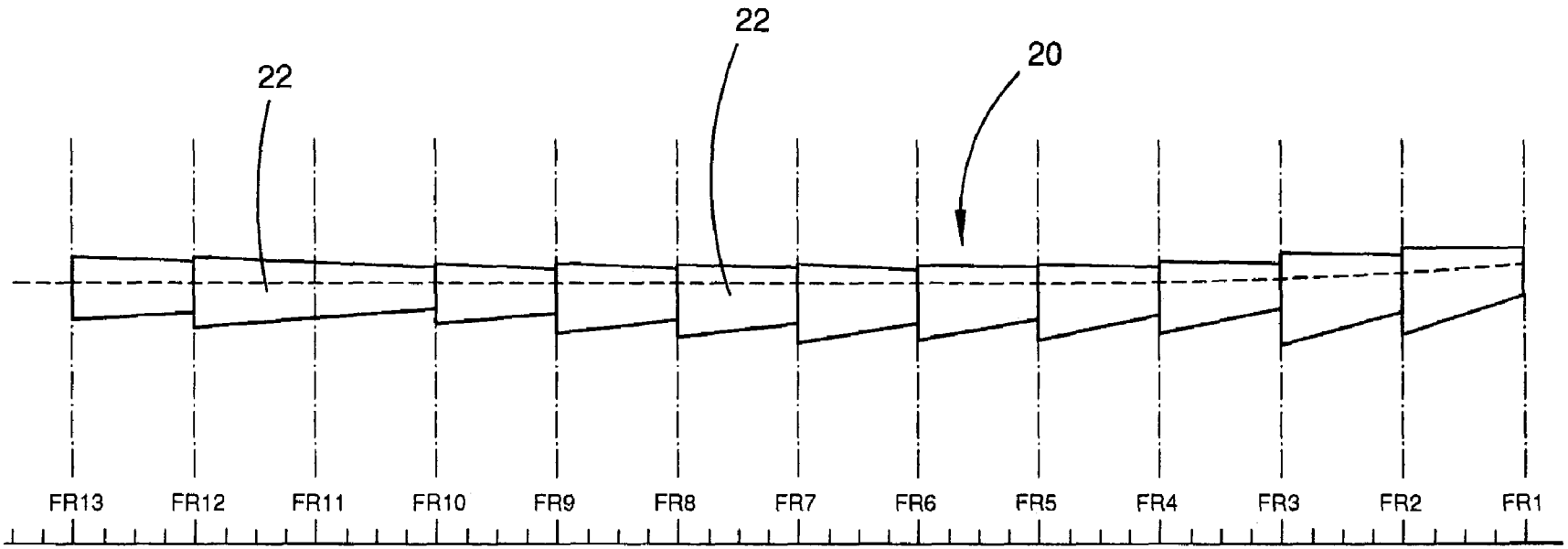
FIG. 6 is a plan view of the plate field.

As shown in the plan view of FIG. 6, this plate field 20 gives a saw-tooth appearance and the horizontal plating is not aligned in one plane and is not watertight as is shown in FIG. 8. FIGS. 5 and 8 illustrate how the longitudinal stiffeners 12 are secured to the horizontal plates 22.

It is understood that there are a variety of mechanisms for securing the stiffeners 12 to the horizontal plates 22. It is usual to use a welded connection which may or may not incorporate spacer pieces to ensure a quality longitudinal weld.

To keep the weight down as much as possible it is understood that the vertical 21 and horizontal plates 22 may have a perforated structure that substantially lightens the plates whilst not substantially detrimentally affecting their strength and rigidity. As shown in FIG. 7, the amah 10 is asymmetrical in cross section though it is understood that a symmetrical construction is also envisaged. FIG. 7 also shows that the horizontal plates 22 are welded to the side plates 11 of the amah. The solid round bar that is in the base of the center of the amah provides a larger area on which to weld the vertical plate fields and provides a basis for the skeletal framework about which the side plates are attached.

It is considered that this construction solves the difficulty of welding in a confined space and making all the connections accessible by ending the elongate stiffeners short of the very pointed bow of the amah by using horizontal plates.

The plate field 20 is confined to the forward part of the amah to the tip of the bow.

The claims defining the invention are as follows:

1. An amah for a high speed seagoing multi hulled vessel, the amah having a stern and a bow, and sides extending upwardly and outwardly from a base line, the sides having longitudinally extending vertically spaced stiffeners, the bow of the amah including a plate field comprising a plurality of sub plates each comprising a vertical plate secured along a longitudinal center line of the amah and supporting a horizontal plate secured to each side of the amah, wherein the horizontal plate of each sub plate, defines a plane that steps upwardly as the base line rakes upwardly towards the bow and the stiffeners terminate and are secured to the horizontal plate, each sub plate being reinforced by at least one supporting web positioned between the horizontal plate and the vertical plate on each side of the vertical plate.

2. The amah according to claim 1, wherein the vertical plate of each sub plate is secured to a solid bar extending along the base line.

3. The amah according to claim 1, wherein the sub plates are perforated to reduce weight.

4. The amah according to claim 1, wherein the amah is asymmetrical as viewed in transverse cross-section.

5. The amah according to claim 1, wherein the sides, stiffeners and plate field are fabricated of aluminum.

6. An amah for a high speed seagoing multi hulled vessel, the amah having a stern and a bow, and sides extending upwardly and outwardly from a base line, the sides having longitudinally extending vertically spaced stiffeners, the bow of the amah including a plate field comprising a plurality of sub plates each comprising a vertical plate secured along a longitudinal center line of the amah and supporting a horizontal plate secured to each side of the amah, wherein the horizontal plate of each sub plate defines a plane that steps upwardly as the base line rakes upwardly towards the bow and the stiffeners terminate and are secured to the horizontal plates, each sub-plate extending longitudinally between 500 mm and 1500 mm, and the horizontal plate has a height that varies from between 500 mm and 1500 mm above an adjacent longitudinal plate.

7. The amah according to claim 6, wherein the vertical plate of each sub plate is secured to a solid bar extending along the base line.

8. The amah according to claim 6, wherein the sub plates are perforated to reduce weight.

9. The amah according to claim 6, wherein the amah is asymmetrical as viewed in transverse cross-section.

10. The amah according to claim 6, wherein the sides, stiffeners and plate field are fabricated of aluminum.

* * * * *